US005333465A

United States Patent [19]

McBride

[11] Patent Number: 5,333,465

[45] Date of Patent: Aug. 2, 1994

[54] UNDERGROUND STORAGE SYSTEM FOR NATURAL GAS

[76] Inventor: Terry R. McBride, 7500 N.W. 103rd St., Oklahoma City, Okla. 73162

[21] Appl. No.: 876,250

[22] Filed: Apr. 30, 1992

[51] Int. Cl.[5] ..... F17C 1/00; F17C 13/08

[52] U.S. Cl. ..... 62/53.1; 137/264; 141/18; 405/53

[58] Field of Search ..... 62/260, 45.1, 48.1, 62/53.1; 137/259, 263, 264; 141/18, 21; 405/53

[56] References Cited

U.S. PATENT DOCUMENTS

| | | | |
|---|---|---|---|
| 1,966,244 | 7/1934 | Hansen | 405/53 |
| 2,491,013 | 12/1949 | Noll et al. | 220/3 |
| 2,796,739 | 6/1957 | Meade et al. | 62/260 |
| 2,932,170 | 4/1960 | Patterson et al. | 62/260 |
| 3,234,745 | 3/1966 | Johnson | 137/263 |
| 3,285,014 | 11/1966 | Nachshen | 405/53 |
| 3,950,958 | 4/1976 | Loofbourow | 62/45 |
| 4,624,390 | 11/1986 | Palmer et al. | 222/3 |
| 4,805,674 | 2/1989 | Knowlton | 141/47 |
| 4,846,088 | 7/1989 | Fanse et al. | 114/72 |
| 4,932,257 | 6/1990 | Webb | 73/40.5 R |
| 4,964,524 | 10/1990 | Halene | 220/3 |
| 4,967,934 | 11/1990 | Andonian | 222/3 |
| 4,977,921 | 12/1990 | Knight et al. | 137/266 |

FOREIGN PATENT DOCUMENTS

| | | | |
|---|---|---|---|
| 113899 | 9/1981 | Japan | 62/53.1 |

*Primary Examiner*—Henry A. Bennet
*Assistant Examiner*—William C. Doerrler
*Attorney, Agent, or Firm*—Dunlap, Codding & Lee

[57] ABSTRACT

An underground storage system for storing natural gas at a vehicular fueling center which dispenses natural gas to natural gas powered vehicles. Compressed gas is stored in tubes positioned vertically in an elongate casing. The ground hole may be drilled using a conventional water well drilling rig and conventional water well casing and well head may be used to house the storage tubes. The tubes contain the natural gas under about 8,000 psi, which provides a much more rapid dispensing rate. The underground place of the storage tubes is safer than conventional above ground storage systems, as the pressurized containers are insulated by the surrounding earth. Moreover, with the storage tubes underground, vandalism is discouraged and the overall appearance of the fueling center is improved. Because the storage tubes contain large volumes of gas at high pressures, a low power compressor can be used. The low power compressor is inexpensive to operate and maintain and is relatively quiet. The inside of the casing will contain any gas escaping the storage tubes, and an extended relief line can be included to discharge any such escaping gas to a site remote from the service area.

28 Claims, 3 Drawing Sheets

UNDERGROUND STORAGE SYSTEM FOR NATURAL GAS

FIELD OF THE INVENTION

The present invention relates generally to storage facilities for natural gas and, more particularly, to underground storage facilities for storing natural gas at vehicular fueling centers dispensing natural gas to natural gas powered vehicles.

SUMMARY OF THE INVENTION

The present invention comprises a system for receiving, storing and dispensing compressed natural gas. The system comprises a conduit for receiving natural gas from a sales line and a gas compressor for compressing the gas received from the sales line. The system further comprises an underground storage facility for storing compressed gas received from the gas compressor and a conduit for conducting compressed gas from the gas compressor to the underground storage facility. Finally, the system includes a dispenser for dispensing gas received from the underground storage facility and a conduit for conducting gas from the underground storage facility to the dispenser.

The present invention further comprises an underground storage facility for storing compressed gas. The underground storage facility comprises an elongate casing adapted to be received in a hole in the ground. The casing has a closed end, an open end and a body portion therebetween. At least one storage tube is included in the facility for containing compressed gas, and each storage tube is adapted to be received in the casing. Each storage tube has a closed end and an open end. The underground storage facility includes a cap assembly, such as a well head assembly, for removably closing the open end of the tube and the open end of the casing. The well head provides internal conduits which connect the inside of the storage tubes and the outside of the casing at the open end of the casing. A conduit also is provided for conducting compressed gas from a compressed gas source to the underground storage facility, which conduit connects to the internal conduits in the cap assembly. A conduit is included for delivering compressed gas from the underground storage facility to a dispensing location, which conduit also connects to the internal conduits in the well head.

DETAILED DESCRIPTION OF THE PREFERRED EMBODIMENTS

The use of compressed natural gas as fuel for motor vehicles is increasing due to the detrimental environmental effects of gasoline and the relative abundance and availability of natural gas. The need for safe and economical systems for storing and dispensing natural gas is, therefore, of ever increasing importance.

Most natural gas powered vehicles are equipped with a tank which contains about 6–10 gallons of gas under a pressure of about 2,500 to 3,000 psi. Heretofore, natural gas for dispensing to vehicles has been stored under pressure in above ground tanks at vehicular fueling centers. Such tanks typically hold about 100 gallons at a pressure of about 3,600 psi. At least this pressure is necessary in order to drive the injection of the gas into the vehicle's tank. However, due to the small pressure differential between the stored gas and the desired pressure in the tanks of most vehicles, the rate at which the compressed gas is delivered to the vehicle tank is relatively slow.

The conventional above ground storage tanks usually are kept near the office at the vehicular fueling center and near the dispensing meter. Consequently, the tanks are accessible to vandals and also are in a position to do damage to people and property in the event of an explosion or fire. The lines which connect the compressor with the storage tanks and the storage tanks with the meter also are above the ground. Thus, the lines are exposed to damage and create a hazardous obstacle on the premises. Because of the small volume of the above ground storage tanks, a high power compressor is necessary in order to fill the tanks rapidly and frequently. Most high pressure compressors emit an unpleasant noise and are expensive to purchase and to operate.

The present invention avoids the disadvantages of prior art storage systems. The system of the present invention uses high volume, high pressure storage tanks which are stored underground. The underground placement of the storage tubes, which can be relatively remote from the dispensing site, greatly reduces the risk of damage in the event of explosion or fire. The absence of unsightly tanks and lines improves the overall appearance of the vehicular fueling center and makes vandalism less likely.

Further, because of the large volume of storage in the facility, slower filling of the storage facility is acceptable and thus a low power compressor may be used. A low power compressor is less costly to purchase and to operate and eliminates the irksome noise of high power compressors.

Still further, because of the high pressure under which the gas in this system is stored, the filling of customer tanks is much faster. This is more convenient for the customer and increases the number of customers which can be serviced by the fueling center operator. These and other advantages will be apparent from the following description of a preferred embodiment of the invention.

Figure 1:
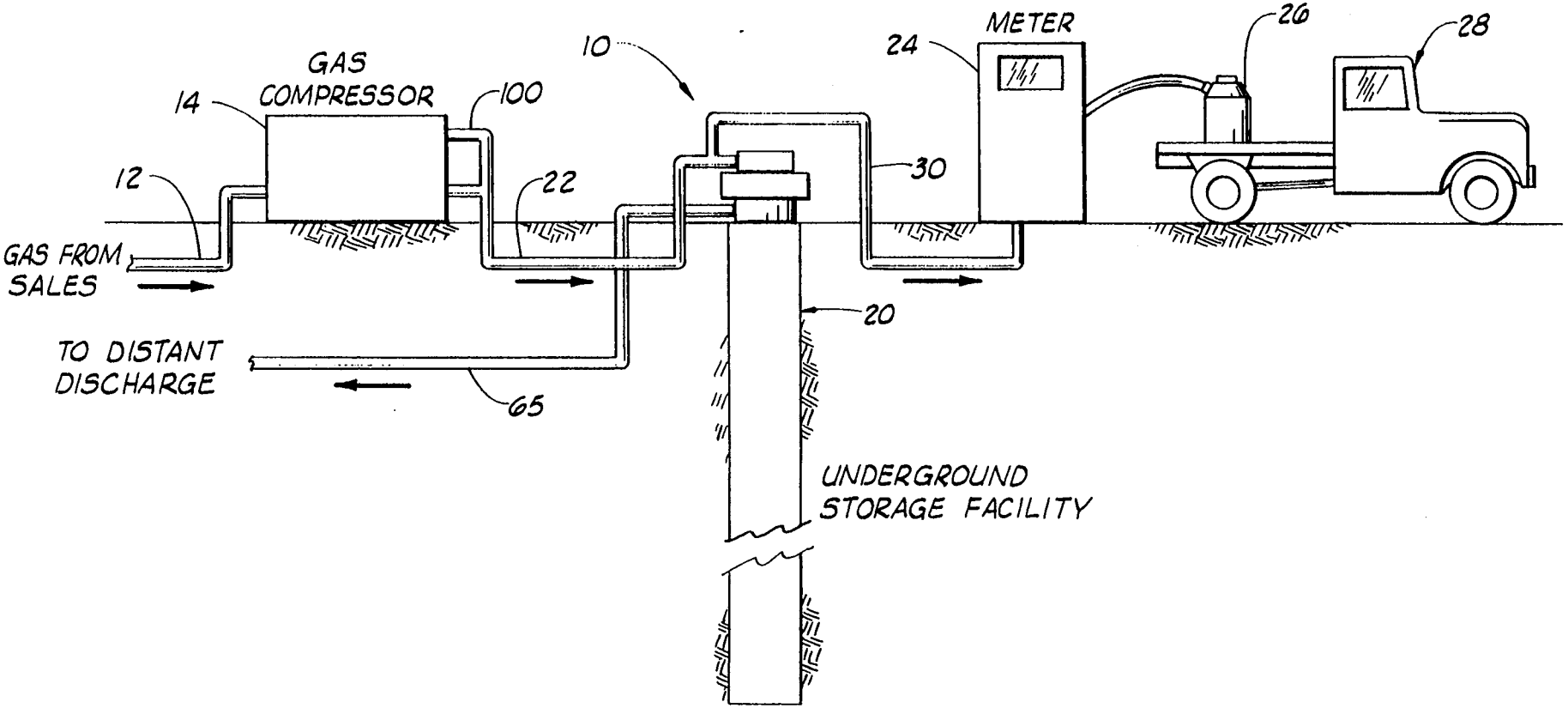
FIG. 1 is a schematic representation of the underground storage system of the present invention.

With reference now to the drawings in general and to FIG. 1 in particular, there is shown therein and designated generally by the reference numeral 10 a system for receiving, storing and dispensing natural gas in accordance with the present invention. Natural gas is received from a nearby sales line (not shown), usually underground, into a conduit 12, which also preferably is underground.

A gas compressor 14 is provided to compress the gas for storage. As discussed previously, the storage facility of this invention has a relatively large volume. For this reason, a low power gas compressor is adequate. The compressor 14 preferably is located remote from the office of the vehicular fueling center (not shown) and, if possible, positioned so as not to be readily visible to passersby.

Referring still to FIG. 1, the system 10 further comprises an underground storage facility designated generally by the reference numeral 20, which will be described in more detail hereafter. The underground storage facility 20 receives compressed gas from the compressor 14 through a conduit 22. The conduit 22 preferably is buried underground except where it connects to the compressor 14 and the underground storage facility 20.

A dispensing mechanism, such as a meter 24, is included in the system 10 for dispensing the compressed gas to the storage tank 26 on a vehicle 28 powered by natural gas. Suitable meters, which also monitor and record the amount of gas dispensed, are commercially available. An underground conduit 30 delivers the pressurized gas from the underground storage facility 20 to the meter 24. Thus, the meter 24 and the office and other facilities of the fueling center (not shown) may be a safe distance from the underground storage facility 20.

Figure 2:
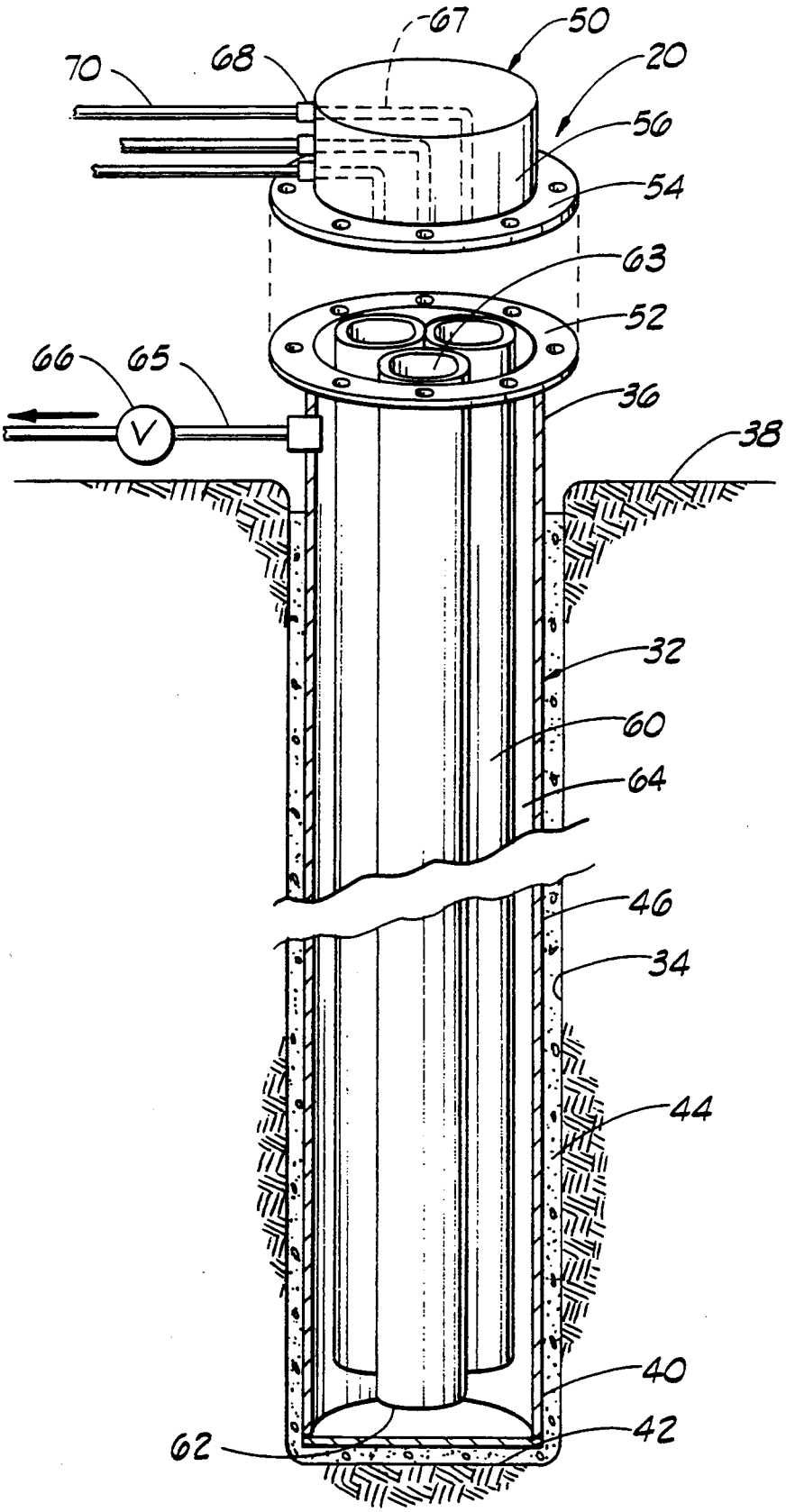
FIG. 2 is a perspective, partially sectional view of an underground storage facility comprising three gas storage tubes.

Turning now to FIG. 2, the underground storage facility 20 will now be described. The facility 20 comprises an elongate housing or casing 32 adapted to be buried in a vertical hole 34 in the ground. A conventional water well drilling rig may be used to drill a hole about 500 to 1000 feet deep and about 24 inches in diameter. A 12 inch water well casing of steel or polyvinyl chloride ("PVC") may be used for the casing 32. The casing 32 should have a length such that, when the casing 32 is installed in the hole 34, the upper end 36 will extend slightly above the surface 38 and the lower end 40 will be supported a few feet above the bottom 42 of the hole 42.

The lower end of the casing 32 should be permanently closed. A well cap welded to the lower end 40 works well for this purpose.

The space 44 in the ground hole 34 around the casing 32 may be filled with a cement slurry. This will stabilize the body portion 46 of the casing 32 and will serve to protect the surrounding earth and nearby ground water systems.

The upper open end 36 of the casing 32 preferably is supported at the surface 38 of the hole 34 by a conventional well head assembly 50. To this end, the upper open end 36 of the casing 32 is provided with a flange 52 which mates with a flange 54 on the upper component 56 of the well head 50. It will be understood that the structure and installation of well casings and well heads is known and, thus, is not shown in detail in the drawings and will not be described in detail herein.

For containing and storing the compressed gas, the underground storage facility 20 comprises at least one and preferably a plurality of storage tubes, only one of which is designated in the drawings by the reference numeral 60. Although the dimensions of the tubes 60 are not critical, it will be understood that the tubes preferably will be of a length slightly less than the length of the casing 32. Similarly, the tubes 60 each should have a diameter which will permit several tubes, and preferably at least three tubes, to fit within the casing 32.

The tubes 60 may be constructed of some sturdy material capable of withstanding high pressures. Standard 4½ inch steel casing (P-110) is quite suitable. As indicated in FIG. 2, three 4½ inch tubes will fit comfortably in a 12 inch casing. Such casing typically has a burst pressure of about 12,000 psi.

Of course, the lower end 62 of each tube 60 must be permanently closed, such as by welding. The upper end 63 should be removably covered by a cap assembly of some sort. Where a water well casing and well head is employed, the well head will serve as the cap assembly. The well head assembly 50, then, will support and cap off the upper open end 63 of the tubes 60 and provide a connection with the flow control assembly yet to be described.

With continuing reference to FIG. 2, in the event a leak should occur in one of the storage tubes 60, escaping gas will collect in the annular space 64 of the casing 32 around the tubes. To release any gas which may collect in the annular space 64 in the casing 32, a conduit 65 may be installed in the side wall of the upper end 36 of the casing. The conduit 65 is equipped with a pressure relief valve 66 set at about 10 psi. Thus, if excessive gas is escaping into the casing 32, the pressure relief valve 66 will open and release the gas into the conduit 65 in a controlled and safe manner.

As seen in FIG. 1, the conduit 65 preferably will have an extended length and will be buried so that the end of the conduit (not shown) can be located in a remote area a safe distance from the fueling center. An alarm (not shown) may be included to alert the fueling center operator of a leak in the storage facility.

Returning to FIG. 2, the upper component 56 of the well head 50 is equipped with internal conduits 67 to provide fluid communication between each of the tubes 60 and a corresponding connector 68 on the outside of the upper component 56. In the embodiment shown and described herein, a conventional triple well head is ideal. As suitable well heads are commercially available, a detailed description is not included herein. Rather, the structure of the well head 50 and the internal conduits 67 are showed only in simplified form by the broken lines in FIG. 2 and FIG. 3.

Referring still to FIG. 2, the connectors 68 on the upper component 56 of the well head 50 provide a means for interfacing the storage tubes 60 with both the gas compressor 14 and the meter 24. A conduit 70 extends from each connector 68 to a flow control assembly which now will be described.

Figure 3:
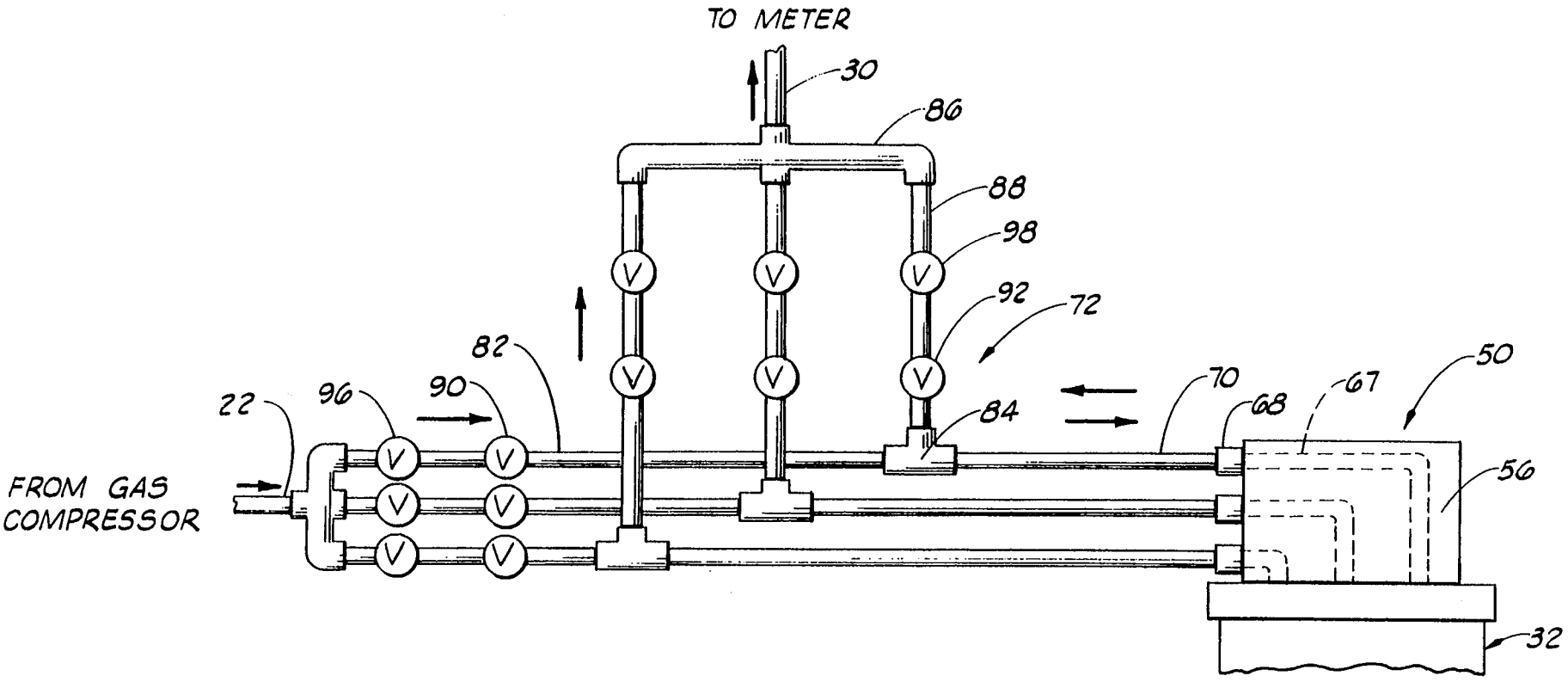
FIG. 3 is a schematic representation of the flow control assembly at the well head of the underground storage facility.

The flow control assembly 72 is depicted in FIG. 3 to which attention now is directed. The flow control assembly 72 preferably comprises a header 80 which connects to the conduit from the gas compressor 14. The header 80 divides the conduit 22 into as many subconduits as there are storage tubes 60 (see FIG. 2) in the casing 32. Each of the subconduits, one of which is designated herein as 82, is joined by a T-joint 84 to the conduit 70 extending from the connector 68 on the well head 50.

The flow control assembly 72 further includes a header 86 which connects to the conduit 30 which delivers compressed gas to the meter 24. The header 86 divides into as many subconduits as there are storage tubes 60 (see FIG. 2). Each subconduit, one of which is designated by the reference numeral 88, connects to the T-joint 84.

A one-way check valve 90 is included in each subconduit 82 to prevent back flow of gas into the compressor 14. Similarly, a one-way check valve 92 is included in each subconduit 88 to prevent back flow of gas into the underground storage facility 20.

To maintain an adequate pressure of gas in each storage tube 60 (see FIG. 2), each subconduit 82 is equipped with an automatic sequencing valve, one of which is designated by the reference numeral 96. Such valves are commercially available and typically comprise a pressure gauge and a pressure responsive switch operatively connected to the gauge to open and close the valve in response to preset minimum and maximum pressure limits.

The valve 96 is set to open in response to a predetermined minimum pressure in the associated storage tube 60. The valve 96 is set to close at a maximum pressure to prevent over pressurization of the storage tube 60. In most instances, it will be desirable to maintain the pressure in the storage tubes 60 between about 5,000 psi and about 8,000 psi. To this end, the automatic sequencing valve 96 may be set to open at about 5,000 psi and to close at about 8,000 psi.

To ensure that an adequate supply of pressurized gas is available to the meter 24 through the conduit 30, another automatic sequencing valve is provided in each subconduit 88. Each such valve, one of which is designated by the reference numeral 98, is set to open in response to a predetermined high pressure and to close in response to a predetermined low pressure. For example, in the embodiment described herein, the automatic sequencing valves may be set to open at 8,000 psi and to close at 5,000 psi.

Now yet another safety feature provided by the present invention will be appreciated. Conventional above ground storage tanks have a burst pressure of about 4,000 psi at most. These tanks typically are filled to about 3,600 psi. Thus, in these tanks there is only about a 10 percent margin between the typical maximum filling pressure and the burst pressure. In the present invention, the burst pressure of the storage tubes 60 is about 12,000, while the maximum filling pressure can be maintained at 8,000 psi, providing greater than a 30 percent margin of safety. Yet, even with this greater safety margin, the system 10 is much more efficient.

Referring still to FIG. 3 and now also to FIG. 1, in operation compressed gas from the compressor 24 is injected into the conduit 22. Each automatic sequencing valve will open or close depending on the pressure in the tubes 60 (see FIG. 2). When the storage tubes 60 are filled to maximum pressure, the automatic sequencing valves will close. If all storage tubes 60 are filled to maximum, the compressor will simply recycle the gas in a conduit 100 which forms a part of the compressor 24 (see FIG. 1). Thus, the flow control assembly 72 ensures that each of the storage tubes 60 will be continually and automatically refilled.

The meter 24 is operated on demand to dispense gas into the gas tank 26 of a vehicle 28. Gas can be received into the conduit 30 from any of the storage tubes 60 (see FIG. 2) in which the pressure is above the minimum pressure to which the automatic sequencing valve 98 is set. Likewise, the valve 98 will close off any partially empty tube. Thus, the flow control assembly 72 ensures that a continuous supply of gas will be available for dispensing to vehicles.

Now it will be appreciated that the present invention provides a safe, attractive and efficient system for storing and dispensing natural gas at vehicular fueling centers. The system permits the use of a quieter compressor which is less expensive to acquire and to maintain. The underground components improve the appearance of the station, discourage vandalism and greatly increase safety. The high pressure storage of the gas provides rapid filling for customers, improving customer convenience and increasing the availability of the dispensing equipment for increased sales.

Changes may be made in the combination and arrangement of the various parts, elements, steps and procedures described herein without departing from the spirit and scope of the invention as defined in the following claims.

I claim:

1. A system for receiving, storing and dispensing compressed natural gas comprising:

a first conduit for receiving natural gas from a sales line;

a gas compressor for compressing the gas received from the sales line through the first conduit;

an underground storage facility for storing compressed gas received from the gas compressor;

wherein the underground storage facility comprises:

a vessel having a lower closed end, a body portion and an upper open end, wherein at least the lower closed end and a portion of the body portion are adapted to be installed underground; and a cap assembly adapted to removably close the open end of the vessel; such cap assembly comprising an internal conduit connecting the inside of the vessel and the outside of the cap assembly;

a second conduit for conducting compressed gas from the gas compressor into the vessel through the internal conduit of the cap assembly;

a dispenser for dispensing gas received from the underground storage facility;

a third conduit for conducting gas from the vessel through the internal conduit of the cap assembly to the dispenser.

2. The system of claim 1 wherein the vessel of the underground storage facility comprises an elongate casing received in a hole in the ground, wherein the underground storage facility further comprises at least one storage tube adapted to be received in the casing, the storage tube having an closed end and an open end which is connected to the cap assembly so that the internal conduit in the cap assembly directs the compressed gas to and from the storage tube.

3. The system of claim 2 wherein the closed end and the body portion of the casing are underground, wherein the open end and the cap assembly for the casing are above ground.

4. The system of claim 3 wherein the casing is vertically positioned underground and the storage tubes are vertically supported in the casing.

5. An underground storage facility for storing compressed gas comprising:

an elongate casing adapted to be received in a hole in the ground, the casing having a closed end, an open end and a body portion therebetween;

at least one storage tube for containing compressed gas and adapted to be received in the casing, the storage tube having a closed end and an open end;

a cap assembly for removably closing the open end of the tube and the open end of the casing, the cap assembly comprising an internal conduit connecting the inside of the storage tube and the outside of the casing at the open end of the casing, and wherein the cap assembly is adapted to provide a connection between an external conduit from a compressed gas source and the internal conduit and between the internal conduit and an external conduit to a dispenser.

6. The underground storage facility of claim 5 having a plurality of storage tubes and further comprising:

automatic sequencing valves for controlling the injection of compressed gas from the compressed gas source into the storage tubes sequentially; and automatic sequencing valves for controlling the delivery of compressed gas to the dispensing location from the storage tubes sequentially.

7. The underground storage facility of claim 6 wherein the closed end and the body portion of the casing are underground, and wherein the open end and cap assembly for the casing are above ground.

8. The underground storage facility of claim 7 wherein the casing is vertically positioned underground and the storage tubes are supported vertically in the casing.

9. An underground storage facility comprising:

at least one storage vessel having a lowered closed end and a body portion and an upper open end, wherein at least the lower closed end and body portion are adapted to be installed underground;

a removable cap assembly adapted to close the open end of the storage vessel, such cap assembly comprising an internal conduit connecting the inside of the storage vessel and the outside of the cap assembly, and wherein the cap assembly is adapted to provide a connection between an external conduit from a compressed gas source and the internal conduit and between the internal conduit and an external conduit to a dispenser.

10. The system of claim 1 wherein the underground storage facility is remote from the dispenser.

11. The system of claim 2 wherein the casing has a burst pressure greater than 10,000 pounds per square inch.

12. The system of claim 2 wherein the cap assembly includes a pressure relief valve which releases gas inside the casing when the pressure inside the casing exceeds a preselected level and wherein the system further comprises a fourth conduit which conducts the released gas to a point remote from the dispenser.

13. The system of claim 2 wherein the storage tube and the casing are at least about 50 feet long, wherein the casing is about 12 inches in diameter and wherein there are three storage tubes each of which are about 4½ inches in diameter.

14. The system of claim 2 wherein the storage tube and the casing are at least about 50 feet long, wherein the casing is about 12 inches in diameter, wherein there are three storage tubes each of which is about 4½ inches in diameter, and wherein the casing and the storage tubes have burst pressures of at least about 10,000 pounds per square inch.

15. The system of claim 2 wherein the storage tube has a burst pressure greater than 10,000 pounds per square inch.

16. The system of claim 1 wherein the storage vessel is at least about 50 feet long and is about 4½ inches in diameter.

17. The system of claim 16 wherein the storage vessel is positioned vertically in the ground.

18. The underground storage facility of claim 5 wherein the casing has a burst pressure greater than 10,000 pounds per square inch.

19. The underground storage facility of claim 5 wherein the cap assembly includes a pressure relief valve which releases gas inside the casing when the pressure inside the casing exceeds a preselected level.

20. The underground storage facility of claim 5 wherein the storage tube and the casing are at least about 50 feet long, wherein the casing is about 12 inches in diameter and wherein there are three storage tubes each of which is about 4½ inches in diameter.

21. The underground storage facility of claim 5 wherein the storage tube and the casing are at least about 50 feet long, wherein the casing is about 12 inches in diameter, wherein there are three storage tubes each of which is about 4½ inches in diameter, and wherein the casing and the storage tubes have burst pressures of at least about 10,000 pounds per square inch.

22. The underground storage facility of claim 5 wherein the storage tube has a burst pressure greater than 10,000 pounds per square inch.

23. The underground storage facility of claim 9 wherein the storage tube has a burst pressure greater than 10,000 pounds per square inch.

24. The underground storage facility of claim 9 wherein the storage tube is at least about 50 feet long and about 4½ inches in diameter.

25. The system of claim 24 wherein the storage tube is positioned vertically in the ground.

26. The system of claim 24 wherein the underground storage facility comprises a plurality of gas storage tubes, wherein the system further comprises automatic sequencing valves for controlling the injection of compressed gas from the gas compressor into the storage tubes sequentially, and wherein the system still further comprises automatic sequencing valves for controlling the delivery of compressed gas to the dispenser from the storage tubes sequentially.

27. The system of claim 1 wherein the vessel has a burst pressure greater than 10,000 pounds per square inch.

28. The system of claim 1 wherein the cap assembly includes a pressure relief valve which releases gas inside the vessel when the pressure inside the vessel exceeds a preselected level and wherein the system further comprises a fourth conduit which conducts the released gas to a point remote from the dispenser.

* * * * *

UNITED STATES PATENT AND TRADEMARK OFFICE

CERTIFICATE OF CORRECTION

PATENT NO. : 5,333,465

DATED : August 2, 1994

INVENTOR(S) : McBride

It is certified that error appears in the above-identified patent and that said Letters Patent is hereby corrected as shown below:

Column 3, line 30, the number "42" should be -- 34 --.

Column 6, line 18, "vessel;" should be -- vessel, --.

Signed and Sealed this

Fourteenth Day of March, 1995

*Attest:*

*Attesting Officer*

BRUCE LEHMAN

*Commissioner of Patents and Trademarks*